US005819154A

United States Patent [19]

Hu et al.

[11] Patent Number: 5,819,154

[45] Date of Patent: Oct. 6, 1998

[54] MANUFACTURING PROCESS OF SINTERED IRON ALLOY IMPROVED IN MACHINABILITY, MIXED POWDER FOR MANUFACTURING, MODIFICATION OF IRON ALLOY AND IRON ALLOY PRODUCT

[75] Inventors: Bo Hu, Kashiwa; Tadayuki Tsutsui, Matsudo; Kei Ishii, Kashiwa; Hideo Shikata, Matsudo; Jun Sakai, Tokyo, all of Japan

[73] Assignee: Hitachi Powdered Metal Co., Ltd., Chiba, Japan

[21] Appl. No.: 760,884

[22] Filed: Dec. 6, 1996

[30] Foreign Application Priority Data

Dec. 8, 1995 [JP] Japan ..... 7-320698
Mar. 5, 1996 [JP] Japan ..... 8-73096

[51] Int. Cl.[6] ..... B22F 3/12

[52] U.S. Cl. ..... 419/11; 419/12

[58] Field of Search ..... 419/11, 12

[56] References Cited

U.S. PATENT DOCUMENTS

| | | | |
|---|---|---|---|
| 2,084,349 | 6/1937 | Laise | 75/137 |
| 3,380,856 | 4/1968 | Pohl | 136/120 |
| 3,451,809 | 6/1969 | Raman et al. | 75/205 |
| 4,512,805 | 4/1985 | Albrecht et al. | 75/244 |
| 4,556,533 | 12/1985 | Oaku et al. | 419/11 |
| 4,623,595 | 11/1996 | Futamura et al. | 428/553 |
| 4,886,637 | 12/1989 | Jandeska, Jr. et al. | 479/11 |
| 4,891,080 | 1/1990 | Del Corso et al. | 148/326 |
| 4,927,461 | 5/1990 | Ciloglu et al. | 75/254 |
| 4,966,626 | 10/1990 | Fujiki et al. | 75/238 |
| 4,976,778 | 12/1990 | Berry et al. | 75/254 |
| 5,166,105 | 11/1992 | Kelsey | 501/96 |
| 5,180,697 | 1/1993 | Claar et al. | 501/96 |
| 5,259,800 | 11/1993 | Ikenove et al. | 75/231 |
| 5,435,966 | 7/1993 | Johnson et al. | 419/47 |
| 5,516,483 | 5/1996 | Shivanath et al. | 419/14 |
| 5,527,504 | 6/1996 | Kishimoto et al. | 419/38 |
| 5,561,827 | 10/1996 | Reeves et al. | 419/5 |
| 5,589,652 | 12/1996 | Arato | 75/235 |

FOREIGN PATENT DOCUMENTS

| | | |
|---|---|---|
| 2320525 | 4/1972 | Germany . |
| 1074911 | 6/1965 | United Kingdom . |
| 1259369 | 4/1968 | United Kingdom . |
| 1305608 | 4/1971 | United Kingdom . |
| 1396666 | 10/1972 | United Kingdom . |
| 1428584 | 6/1973 | United Kingdom . |
| 1445075 | 3/1975 | United Kingdom . |
| 2223280 | 9/1989 | United Kingdom . |

*Primary Examiner*—Daniel J. Jenkins
*Attorney, Agent, or Firm*—Thomas, Kayden, Horstemeyer & Risley

[57] ABSTRACT

Disclosed is a sintered iron alloy, a method of manufacturing the same, a powdered mixture used for manufacturing the same and a method of modifying the surface of the iron alloy. The sintered iron alloy is produced by compacting a powdered mixture comprising: boron or boron compound which is selected from the group consisting of boron oxide, boron sulfide, boron halide, boron hydride, boric acid, borate and tetrafluoroborate; 0.1 to 2.0% by weight of graphite; and iron, and sintering it. Alternatively, the iron alloy is produced by impregnating a modifier containing boron or boron compound, into a green compact, a presintered compact or sintered body which contains iron and carbon, and heating it.

16 Claims, 2 Drawing Sheets

MANUFACTURING PROCESS OF SINTERED IRON ALLOY IMPROVED IN MACHINABILITY, MIXED POWDER FOR MANUFACTURING, MODIFICATION OF IRON ALLOY AND IRON ALLOY PRODUCT

BACKGROUND OF THE INVENTION

1. Field of the Invention

The present invention relates to a method for manufacturing a sintered iron alloy which is improved in machinability, a mixed powder which is used for manufacturing the sintered iron alloy and modification treatment for improving machinability of the iron alloy material, and more particularly to a method of manufacturing a sintered iron alloy which contains carbon and which is prominent in processing ability and recompressibility, at a low manufacturing cost.

2. Description of the Prior Art

Sintered iron alloy materials which are manufactured by a powder metallurgical method generally have an advantage that the process of making various parts for machines, vehicles, etc. from the sintered iron alloy material, i.e. processing treatment such as molding, cutting, machining and the like, is quite simple in comparison with those for other iron alloy materials. However, since machinability of the iron alloy material is rather low, it is a serious defect when they are processed.

For improving machinability of the sintered iron alloy material, the conventional manufacturing method of the sintered iron alloy material had applied one of the measures of using an iron powder containing sulfur, of mixing the raw material with a sulfide compound, and of subjecting to sulfur treatment in which it is heated in a gaseous hydrogen sulfide atmosphere. However, the sintered iron alloy material obtained by the above conventional method is short of strength so that impact resistance deteriorates and easily etched.

Japanese Laid-Open Patent Application of publication No.(Kokai) H3-79701 discloses that it is possible to reduce the friction coefficiency of the sintered iron alloy material on the machining tool or cutting tool by adding a boron nitride powder into a mixed raw powder for the sintered iron alloy material. However, the boron nitride powder to be used in the method of the above publication document must have high purity, and a boron nitride of high purity is expensive. Therefore, practical use of this method is economically difficult.

In the meantime, according to current demand for weight reduction of automobiles, aluminum alloy materials have been increasingly employed for manufacture of the machine parts of automobiles. This gives an occasion for necessarily treating both of a sintered iron alloy material and an aluminum alloy material equally by using the same processing means. This means that the sintered iron alloy material is required to have as high a machinability as that of the aluminum alloy material, e.g. aluminum alloy ADC 14 according to Japan Industrial Standards. However, even if the above conventional method is used, the machinability of the sintered iron alloy material obtained thereby is insufficient so that it does not satisfy the latest requirement mentioned above. Additionally, the demand for improving machinability of the sintered iron alloy material is still increasing.

In the above circumstances, there is another conventional method used for improvement of machinability, and this method suggests that a filler such as parafine, resin and the like is filled into pores of the sintered iron alloy material. However, the filler tends to damage the cutting tool and the life span of the machining device is made short. Morever, after the processing of the sintered iron alloy material, this filler must be completely removed from the obtained machine part, prior to use of it. This is quite troublesome and economically disadvantageous.

SUMMARY OF THE INVENTION

It is, therefore, an object of the present invention to provide a powder metallurgical method of manufacturing a sintered iron alloy material in which machinability is improved without deterioration of strength and corrosion resistance.

It is another object of the present invention to provide a mixed powder which is used for manufacture of a sintered iron alloy material having improved machinability as well as impact strength and corrosion resistance.

It is still another object of the present invention to provide a method of improving machinability of a sintered iron alloy material which is manufactured through a powder metallurgical process so that impact strength and corrosion resistance of the product are maintained.

It is another object of the present invention to provide a sintered iron alloy material which has improved machinability as well as impact strength and corrosion resistance so that it is suitable for manufacturing machine parts through machining processes such as cutting, grinding and the like.

In accordance with the present invention, there is provided a powdered mixture for manufacturing a sintered iron alloy, comprising: boron or boron compound which is selected from the group consisting of boron oxide, boron sulfide, boron halide, boron hydride, boric acid, borate and tetrafluoroborate; 0.1 to 2.0% by weight of graphite; and iron.

Moreover, there is also provided a process of manufacturing a sintered iron alloy, comprising the steps of: preparing a powdered mixture comprising: boron or boron compound which is selected from the group consisting of boron oxide, boron sulfide, boron halide, boron hydride, boric acid, borate and tetrafluoroborate; 0.1 to 2.0% by weight of graphite; and iron; compressing the powdered mixture to form a green compact; and sintering the green compact in a non-oxidizing atmosphere at a temperature of 1,000° to 1,250° C.

Moreover, there is provided a process of manufacturing a sintered iron alloy, comprising the steps of: preparing a powdered mixture comprising iron and containing 0.1 to 2.0% by weight of graphite; compressing the powdered mixture to form a green compact; preparing a solution containing a boron component which is selected from the group consisting of boron, boron oxide, boron sulfide, boron halide, boron hydride, boric acid, borate and tetrafluoroborate; impregnating the solution into the green compact; and sintering the green compact in a non-oxidizing atmosphere at a temperature of 1,000° to 1,250° C. to obtain a sintered iron alloy.

Moreover, there is also provided a process of manufacturing a sintered iron alloy, comprising the steps of: preparing a powdered mixture comprising iron and containing 0.1 to 2.0% by weight of graphite; compressing the powdered mixture to form a green compact; presintering the green compact at a temperature of 300° to 950° C. to obtain a presintered compact; preparing a solution containing a boron component which is selected from the group consisting of boron, boron oxide, boron sulfide, boron halide, boron hydride, boric acid, borate and tetrafluoroborate; impregnating the solution into the presintered compact to obtain impregnated compact; and sintering the impregnated compact in a non-oxidizing atmosphere at a temperature of 1,000° to 1,250° C.

Moreover, there is also provided a method of modifying an iron alloy containing carbon, comprising the steps of: preparing a solution containing a boron component which is selected from the group consisting of boron, boron oxide, boron sulfide, boron halide, boron hydride, boric acid, borate and tetrafluoroborate; impregnating the solution into the iron alloy; and heating the iron alloy after the impregnating step in a non-oxidizing atmosphere at a temperature of 1,000° to 1,250° C.

According to the above construction, hardness of the iron alloy is reduced by addition of the boron component, while satisfactory strength of the iron alloy is retained. Moreover, it is also possible to reduce hardness of a part of the iron alloy material so that only the portion to be necessarily processed is improved in machinability. Accordingly, the sintered iron alloy can be manufactured at a low cost and it can be suitably used as a material for various machine parts for automobiles and the like.

The features and advantages of the sintered alloy material according to the present invention will be more clearly understood from the following description of the preferred embodiments of the present invention taken in conjunction with the accompanying drawings.

DETAILED DESCRIPTION OF THE PREFERRED EMBODIMENTS

Figure 1:
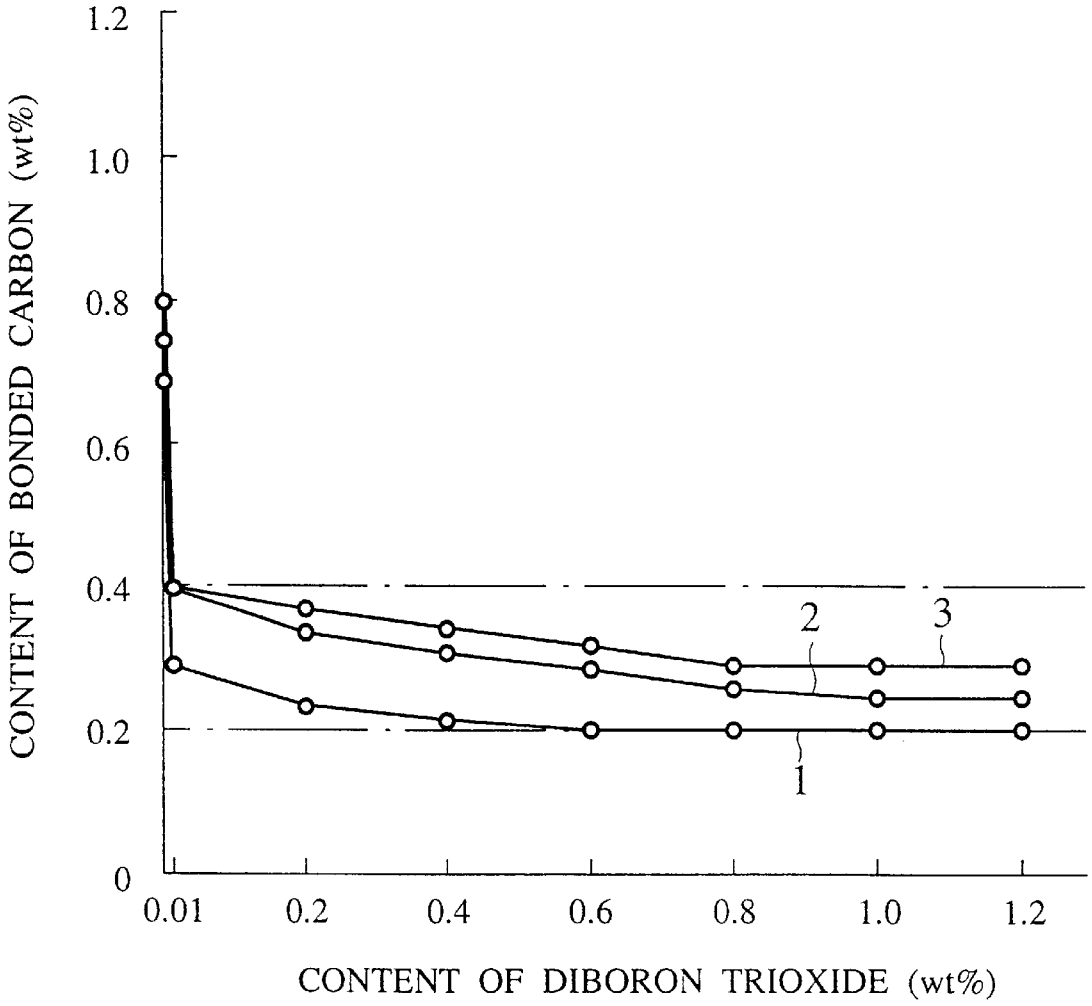
FIG. 1 is a graph showing the relationship between the content of diboron trioxide contained in the powdered raw material for the sintered iron alloy product and the content of bonded carbon in the sintered iron alloy product obtained therefrom.

In conventional powder metallurgy, a graphite powder is often introduced as a solid lubricant into the powdered raw material for manufacturing an iron alloy product. It works, as a solid lubricant, to reduce friction, thereby improving machinability of the iron alloy product made from the powdered raw material. However, in order to make a practically useful iron alloy product, the conventional raw material described above must be necessarily sintered at a low temperature such that is below the thermal range in which the carbon may be diffused into the base of the iron alloy. This naturally results in fall of strength and corrosion resistance of the conventional iron alloy material due to the low sintering temperature.

The inventors of the present application have searched for the measures of producing an iron alloy product which possesses strength, corrosion resistance and machinability. As a result, it has been found that, if the carbon dispersed among the iron base are inhibited from being diffused into the iron base even at a high temperature, sintering at a high temperature becomes possible and an iron alloy product having high strength is possibly manufactured. Moreover, it has been also found that boron and boron compounds are effective for reducing diffusion of the carbon into the base of the alloy material.

In detail, if simple boron or specific compound boron according to the present invention is added to the powdered raw material for the iron alloy material which contains carbon, and if the powdered raw material with the boron component is heated in a common-non-oxidizing atmosphere at a temperature that carburization develops to iron, the boron component is diffused into the iron before the carbon is diffused. As a result, carburizing of the carbon to the iron base is inhibited by the boron component, and the obtained iron alloy with the boron component has metallographic structure which contains a large amount of a ferrite phase. Accordingly, hardness of the iron alloy is remarkably reduced so that machinability of the iron alloy is notably improved. At the same time, it becomes possible to sinter the raw material at high temperatures so that satisfactory strength is imparted to the iron alloy product, without deterioration of machinability.

The effect of the boron component can be seen from FIG. 1 which is a graph showing the relationship between the content of diboron trioxide contained in the powdered raw material for manufacturing the sintered iron alloy product and the content of bonded carbon in the sintered iron alloy product obtained therefrom (The details of FIG. 1 will be described in the item of EXAMPLES). As clearly shown in FIG. 1, the ratio of bonded carbon falls to a low level by addition of diboron trioxide. This means that diboron trioxide works to keep free and non-diffused a large part of the carbon component during the heating and prevent the carburizing. The free carbon remains dispersed among the iron base phase and exhibits solid lubricability to impart machinability to the iron alloy product. In the present invention, the boron component is defined as a boron-containing substance which works like diboron trioxide of FIG. 1 and which has ability to prevent carburizing of the iron base. That boron component of the resent invention includes simple boron and boron compound, and specific examples of the boron compound will be illustrated below.

The boron compound which is used in the present invention can be selected from boron oxide, boron sulfide ($B_2S_3$), boron halide, boron hydride, boric acid, borate (salt of boric acid) and tetrafluoroborate.

The boron oxide includes diboron trioxide ($B_2O_3$, called also boron trioxide or boric anhydride), diboron dioxide ($B_2O_2$), tetraboron trioxide ($B_4O_4.2H_2O$), tetraboron pentaoxide ($B_4O_5$) and the like.

The boron hydride may present in various forms such as $BH_3$, $B_2H_6$, $B_4H_{10}$, $B_5H_9$, $B_5H_{11}$, $B_6H_{10}$, $B_6H_{12}$, and $B_{10}H_{14}$.

The boron halide includes boron trifluoride ($BF_3$), boron trichloride ($BCl_3$), boron tribromide ($BBr_3$), boron triiodide ($BI_3$), diboron tetrachloride ($B_2Cl_4$), diboron tetrabromide ($B_2Br_4$), diboron tetraiodide ($B_2I_4$) and the like.

The boric acid can be classified into orthoboric acid ($H_3BO_3$), metaboric acid ($HBO_2$) and tetraboric acid ($H_2B_4O_7$).

The borate can be classified into orthoborate, diborate, metaborate, tetraborate, pentaborate and octaborate, and specifically includes various borate minerals such as borax ($Na_2B_4O_7.10H_2O$), larderelite ($(NH_4)_2B_{10}O_{16}.5H_2O$), kotoite ($Mg_3(BO_3)_2$) and the like.

The tetrafluoroborate includes ammonium tetrafluoroborate ($NH_4BF_4$) and the like.

Among the above specific examples of the boron component, diboron trioxide ($B_2O_3$) is much effective for prevention of carburizing or deterioration in strength of the iron alloy product and for improvement of machinability, while it's market price is rather low. Therefore, diboron trioxide is most suitable and useful for the prevent invention.

In the present invention, it is possible to employ the boron component, i.e. simple boron and the boron compound as described above, in either of two manners. One is to employ the boron component as a surface modifier for making soft only a part of the iron alloy body like a surface portion to be machined or cut off, and another is to employ the boron component as an additive into a powdered raw material for manufacturing an iron alloy material having good machinability and strength as a whole. Below, each of the two manners will be described in detail.

In the first manner, the boron component is firstly dissolved into a solvent in which the boron component is soluble, and this solution is used as the surface modifier. Specific examples of the solvent usable for preparation of the surface modifier include water and alcohol such as methanol, ethanol, 1-propanol, 2-propanol and the like. Of course, various mixtures of water and the alcohol described above are also usable.

The prepared solution or surface modifier is applied to a portion of an iron-containing and carbon-containing body which is to be processed or machined. The surface modifier is impregnated into the body to be processed, thereby a modified layer containing the boron component is formed at the surface portion of the body. The iron-containing and carbon-containing body may be any of a green compact of the powdered raw material, a presintered compact and a sintered iron alloy body, which has permeability on at least the portion to be modified. This equally means that the surface modifier of the present invention can be effectively utilized either in the manufacturing process of the sintered iron alloy material, or after that, or both of that. Of course, if the iron alloy body to be surface-modified is placed in an atmosphere of a reduced pressure to remove the air therefrom before the impregnation, the surface modifier is impregnated more easily. Alternatively, it is also possible to soak the iron alloy body in the surface modifier.

After drying the body impregnated with the surface modifier, it is then heated or sintered in a non-oxidizing gas atmosphere. The heating temperature is preferably determined to a range of 1,000° to 1,250° C., and it is preferred to heat the body for about 30 minutes or more. During the heating operation, the boron component in the modified layer precedes the carbon being diffused into the iron base, and diffusion of the boron component inhibits the carbon from being diffused into the iron base. Therefore, the metallographic structure of the modified layer has non-diffused free carbon and an iron base containing a large amount of ferrite phase. As a result, hardness of the modified layer is kept low. On the other hand, since the non-modified portion of the body does not contain the boron component, the carbon in the non-modified portion is diffused and dissolved to make the iron alloy hard.

Since the thickness of the modified layer formed on the iron alloy body changes in accordance with the concentration of the boron component in the surface modifier and the manner and time for impregnating the surface modifier, it is possible to make a desired thickness of the modified layer suitably by controlling the above factors. The surface modifier impregnates easier into a presintered compact than a green compact or a sintered body. If a compact in which a fatty acid is contained as a lubricant is modified, it is desired to remove the fatty acid from the compact by using an organic solvent, etc., before the surface modifier is impregnated into the compact. In a case of the surface modification of a sintered body in which the carbon has been already diffused and dissolved into the iron base such as to form a pearlite phase or a cementite phase, the boron component of the surface modifier substitutes for the diffused carbon or bonds to the carbon to disconnect the carbon from the iron, thereby a ferrite phase is produced.

Moreover, the hardness of the modified layer after the heating treatment also changes in accordance with the kind and the amount of the boron component impregnated into the modified layer. Therefore, the concentration of the surface modifier is appropriately determined according to the kind of the boron component so that the modified layer has a desired machinability after the heating treatment. It is preferred to regulate the concentration of the boron component in the surface modifier to a range of about 0.01 to 0.3 g/ml for easy operation and precise control of the thickness of the modified layer.

In the first manner described above, it is possible to improve machinability of the sintered iron alloy material only at the portion which is to be machined or cut off. Therefore, with respect to the other portion of the sintered iron alloy material that is not modified, the mechanical properties do not change. Moreover, since improvement of machinability is performed by using a liquid containing the boron component, it is easy to control the thickness and the hardness of the modified portion by suitably regulating concentration of the boron component in the surface modifier and impregnation time and appropriately managing the impregnation manner. In addition, the surface modifier of the present invention is a liquid which can be prepared at a low cost and easily handled. Moreover, as described above, the first manner is advantageous in that it is applicable to any of a green compact, a presintered compact and a sintered body to impart a desired machinability easily.

The first manner described above is quite useful and this makes it possible to improve a processing performance and a life span of the machining tool, etc., in particular, when it is applied to a manufacturing process of a machine part such as a bearing cap and a synchronizer hub of an engine for automobiles, various gears for general purpose engines, parts of office automation equipment, parts of machine tools and the like, where cutting work, sizing treatment and the like are required.

In the second manner according to the present invention, the boron component is used as an additive for manufacturing an iron alloy material having both good machinability and sufficient strength as a whole. Therefore, the boron component is directly added into the powdered raw material for manufacturing the iron alloy product to prepare a mixed powder which contains iron, carbon and the boron component. This mixed powder is compressed to form a green compact, and it is then sintered to produce an iron alloy material.

It is also possible to use the mixed powder described above in order to make an iron alloy body which partially has a layer containing the boron component at the surface portion to be machined. Specifically, if the mixed powder containing the boron component is laminated on a compact which has no boron component and if the laminated body is then compressed and sintered, the laminate containing the boron component forms a surface layer which can be easily machined.

The mixed powder is preferably blended as follows.

Firstly, the content of the boron component in the mixed powder which is to be formed into an easily machinable alloy is appropriately determined in accordance with the kind of the boron component. If diboron trioxide is used as the boron component, the content is preferably settled to a range of about 0.01 to 1.0% by weight. If the content of diboron trioxide is less than 0.01% by weight, inhibition of the carbon from being diffused into the iron base becomes insufficient so that pearlite is produced after the sintering. On the other hand, if the content exceeds 1.0% by weight, the inhibition effect of the boron component does not increase more, and strength of the obtained iron alloy material falls due to a large amount of non-diffused boron component remaining in the iron base.

If using either of the other boron components, the content of the boron component is appropriately changed. Specifically, in a case of using either of orthoboric acid ($H_3BO_3$), borax (estimated as a form of $Na_2B_4O_7$) and boron sulfide ($B_2S_3$), the content is preferably settled to a range of about 0.05 to 2% by weight, and if using boron triiodide ($BI_3$) or ammonium tetrafluoroborate ($NH_4BF_4$), the amount is settled to a range of about 1.0 to 3.0% by weight. In a case of boron halide ($B_{10}H_{14}$), the content is preferably settled to a range of about 0.01 to 1% by weight.

The boron component is powdered at an appropriate particle size, and there is no specific limitation for it in the present invention. Usually, the boron component provided has a mean particle size of about 1 to 20 $\mu$m, and such a powder of the boron component can be suitably utilized in the present invention.

Of course, it is also possible in the present invention to utilize two or more boron components described above in combination. Moreover, a powdered boron nitride which often contains diboron trioxide as an impurity is also applicable for the boron component of the present invention. Since a boron nitride powder containing about 10% by weight or more of diboron trioxide is rather cheap in the market in comparison with one with less impurity, to use such a boron nitride powder with a large amount of diboron trioxide is economically advantageous. Moreover, to use both of diboron trioxide and boron nitride exhibits synergistic effect to further improve machinability of the iron alloy material obtained. In this view, it is preferable to use a boron nitride powder containing about 10 to 40% by weight of diboron trioxide. In this case, the amount of the boron nitride powder to be blended into the raw material is appropriately determined so that the mixed powder contains the diboron trioxide at a preferable content as described above. Accordingly, the preferable amount of the boron nitride powder comes to about 0.1 to 2.5% by weight. Also in a case of using a boron nitride containing diboron trioxide, a powder having a general mean particle size of about 1 to 20 $\mu$m can be suitably utilized according to the present invention.

If a boron nitride powder containing diboron trioxide is utilized, the metallographical structure of the sintered iron alloy has carbon (graphite) and boron nitride which are dispersed in a base being composed of a ferrite phase and a pearlite phase. It has been found that such an iron alloy material has equal machinability to that of aluminum alloys.

The mixed powder to be manufactured into the sintered iron alloy according to the present invention contains powdered carbon, and specifically, a graphite powder is utilized. In order to impart necessary strength and sufficient machinability to the sintered iron alloy, it is desired to mix the graphite powder at a content of about 0.1% by weight or more. However, if the content of the graphite powder exceeds about 2.0% by weight, the excess amount of the carbon forms a pearlite phase which damages machinability of the obtained iron alloy material, and this damage cannot be sufficiently recovered even by addition of a large amount of the boron component, because the effect of the boron component exceeding a certain level cannot be expected as described above. Therefore, the content of the graphite powder is preferably determined within a range of about 0.1 to 2.0% by weight. The graphite powder may have a mean particle size of about 1 to 10 $\mu$m which is generally used in the field of powder metallurgy.

Moreover, the mixed powder of the present invention may contain other lubricants such as a zinc stearate powder and the like and other common additives, as occasion arises. The rest of the mixed powder is then satisfied with balance iron. The content of the iron powder in the mixed powder is preferably determined to about 90% by weight or more, and any iron powder having a mean particle size of about 20 to 100 $\mu$m can be suitably utilized.

The material for introduction of the iron component is thus not limited to only a simple iron powder, but an iron alloy powder, a partially diffused iron alloy and the like are also applicable.

The mixed powder obtained by preferably blending the iron, the carbon, the boron component and other additives as described above is compressed to a green compact preferably having a green density of about 6.4 to 7.2 g/cm$^3$ in a desired shape. The green compact is then sintered in a non-oxidizing gas atmosphere. For examples of the non-oxidizing atmosphere, hydrogen gas, nitrogen gas, dissociated ammonia gas, argon gas, exothermic gas, endothermic gas, vacuum and the like can be illustrated. The sintering temperature is preferably determined to a range of about 1,000° to 1,250° C. Alternatively, the green compact may be presintered at a lower temperature in a non-oxidizing gas, before the main sintering. The sintered iron alloy material has a excellent machinability due to reduction of hardness, while sufficient strength is maintained. Of course, the green compact or the sintered iron alloy containing the boron component may be further treated with the surface modifier described above, as occasion arises.

In actual manufacture of machine parts, the sintered iron alloy material is subjected to necessary processing operation such as sizing, coining, cutting, machining and the like. Also in the present invention, the sintered iron alloy material obtained above by either of the first manner or second manner is subjected to processing operation. The sintered iron alloy material of the present invention is advantageous in that it is further made fine by the pressure which is applied for sizing, coining and the like, and that the processing can be achieved with a small difference in dimension.

It is also possible to make harder the surface of the sintered iron alloy material after the processing operation by subjecting it to carburization treatment or other similar treatments.

As a result of the above operations, it is possible to manufacture various machine parts having sufficient strength and high dimensional accuracy at a low cost.

EXAMPLES

Now, a few samples of the sintered iron alloy products of the present invention and some samples of the conventional materials will be described.

Example 1

[Sintered Iron Alloy with Boron Component]

(Raw Materials)

For the iron base, a simple iron powder having a mean particle size of 50 μm was prepared.

Moreover, for introduction of the boron component, a diboron trioxide powder having a mean particle size of 2 μm was prepared.

Furthermore, for the carbon to be dispersed in the iron base, a graphite powder having a mean particle size of 5 μm was prepared.

Additionally, a zinc stearate powder for the powder lubricant having a mean particle size of 5 μm was prepared.

(Manufacture of Sample Nos. 1 to 7)

Referring to Table 1, the sintered iron alloy materials of Sample Nos. 1 to 7 were prepared by using the above-described raw materials, as follows.

In each case, firstly, the raw material powders were blended, referring to the composition ratio of the corresponding sample number, to obtain a mixture, in which 0.8% by weight of the zinc stearate powder was blended as a lubricant. Then, the mixture was agitated for 30 minutes by using a V-shaped rotary blender. Next, the mixture was compacted to form ten planar compacts having a dimension of 12.5 mm×32 mm×5 mm and a green density of 6.7 g/cm$^3$. The green compacts were sintered in a non-oxidizing atmosphere at a temperature of about 1,130° C. for 60 minutes. In this time, a dissociated ammonia atmosphere containing 25% nitrogen gas and 75% hydrogen gas was used as the non-oxidizing atmosphere. After cooling to a room temperature, the test plates made of the sintered iron alloy material for each of Sample Nos. 1 to 7 were obtained.

(Measurement of Mechanical Properties)

The sintered iron alloy materials of Sample Nos. 1 to 7 were measured for machinability and flexural strength as follows. The results of the measurements are shown in Table 1.

The machinability was measured in accordance with a drilling test by using an HSS drill with a diameter of 3 mm. Specifically, a test plate was drilled by the HSS drill which was revolved at a speed of 1000 rpm, with applying a load of 9 kgf to the drill. The operation time which was necessary for drilling up or completely penetrating the test plate was measured for estimation of the machinability of the sintered iron alloy product. The above drilling operation was repeated on five test plates in the same conditions, and an average value of the five measured values was calculated. The average value is shown in Table 1.

The flexural strength was measured by three-point bending test in accordance with Japanese Industrial Standard No. Z 2248 (method of bending test for metallic materials). The bending test was repeated with five test plates in the same conditions, and an average value thereof was calculated. The average value is shown in Table 1.

TABLE 1

| Sample No. | Iron Powder (wt %) | Diboron Trioxide (wt %) | Graphite Powder (wt %) | Operation Time (sec) | Flexural Strength (MPa) |
|---|---|---|---|---|---|
| 1 | 99.09 | 0.01 | 0.1 | 10 | 420 |
| 2 | 97.7 | 0.5 | 1.0 | 10 | 456 |
| 3 | 96.2 | 1.0 | 2.0 | 10 | 460 |
| 4 | 98.2 | 0 | 1.0 | 60 | 634 |
| 5 | 97.1 | 1.1 | 1.0 | 10 | 230 |
| 6 | 98.7 | 0.5 | 0 | 10 | 200 |
| 7 | 96.6 | 0.5 | 2.1 | 50 | 500 |

For each of the Sample Nos. 1 to 3, a micrograph of the test plate shows a metallographic structure in which the non-diffused or non-dissolved graphite is dispersed in the base containing a ferrite phase and a pearlite phase. Moreover, as clearly understood from the Sample Nos. 1 to 5, addition of the diboron trioxide at a ratio of 0.01% by weight or more improves machinability of the sintered iron alloy. However, extra amount of diboron trioxide such as to exceed 1.0% by weight causes deterioration of flexural strength, which is shown in Table 1 as the fall from 460 MPa to 230 MPa. This is due to a large amount of non-diffused diboron trioxide. If the diboron trioxide is insufficient or less than 0.01% by weight, diffusion of the carbon will not be inhibited, thereby a pearlite phase is produced to damage machinability of the product. Therefore, the drilling time of Sample No. 4 is so long as to extend to 60 seconds. In view of the above, the preferable content of the diboron trioxide is appropriately determined to about 0.01 to 1.0% by weight.

Moreover, it is preferred to limit the amount of the carbon to 2.0% by weight or less, because machinability is reduced by an extra amount of the carbon. This is clearly shown by the results of Sample Nos. 3 and 7, and the drilling time of Sample No. 7 extends to 50 seconds. However, in order to impart sufficient strength to the sintered iron alloy, it is preferred to add at least 0.1% by weight of carbon so that a certain amount of carbon is diffused in the iron base. The low flexural strength of Sample No. 6 is due to absence of the carbon. In view of the above, the preferable content of the graphite is about 0.1 to 2.0% by weight.

Example 2

[Sintered Iron Alloy with Use of Impure Boron Nitride]

(Manufacture of Sample No. 8)

In order to prepare test plates made of the sintered iron alloy material of Sample No. 8, the manufacturing process for Sample No. 2 was repeated, with using the raw materials described in Example 1, excepting that the composition ratio was changed referring to Table 2, and that the diboron trioxide powder was appropriately changed to a boron nitride powder having a mean particle size of 2.9 μm and containing diboron trioxide at a content of 20% by weight as an impurity.

(Measurement of Mechanical Properties)

The sintered iron alloy material of Sample No. 8 was measured for machinability and flexural strength by repeating the measurement operation of Example 1 for the prepared test plates. The results of the measurements are shown in Table 2.

TABLE 2

| | Iron | Imp. Boron Nitride Powder [Diboron | Graphite | Operation | Flexural |
|---|---|---|---|---|---|

| Sample No. | Powder (wt %) | Trioxide] (wt %) | Powder (wt %) | Time (sec) | Strength (MPa) |
|---|---|---|---|---|---|
| 8 | 95.7 | 2.5 [0.5] | 1.0 | 8 | 456 |
| 2 | 97.7 | — [0.5] | 1.0 | 10 | 456 |

The sintered iron alloy material of Sample No. 8 contained the same amount of diboron trioxide as that of Sample No. 2.

The micrograph of the test plate of Sample No. 8 shows a metallographic structure in which the non-diffused or non-dissolved graphite and the boron nitride are dispersed in the base containing a ferrite phase and a pearlite phase. Flexural strength of Sample No. 8 is equal to that of Sample No. 2, and the operation time for drilling the Sample No. 8 is shorter than that of Sample No. 2. Namely, the sintered iron alloy material of Sample No. 8 has been further improved in machinability. This is considered to be a synergistic effect of the diboron trioxide which is the boron component according to the present invention and the boron nitride.

Example 3

[Bonded Carbon in Sintered Iron Alloy with Diboron Trioxide]

(Manufacture of Sample Nos. 9 to 32)

In order to prepare test plates made of each of the sintered iron alloy materials of Sample Nos. 9 to 32, the manufacturing operation for Sample No. 1 was repeated, with using the raw materials described in Example 1, excepting that the composition ratio was changed referring to Table 3, and that the atmosphere at the sintering treatment was appropriately changed to either of a dissociated ammonia atmosphere (a), a butane denatured gas atmosphere (b) and a nitrogen gas atmosphere (c) as shown in Table 3.

(Measurement of Content of Bonded Carbon)

The sintered iron alloy materials of Sample Nos. 9 to 32 were measured for the content of bonded carbon (wt %) by using the method for quantitative analysis of free carbon in accordance with Japanese Industrial Standard No. G 1211. The results of the measurements are shown in Table 3 and FIG. 1.

TABLE 3

| Sample No. | Iron Powder (wt %) | Diboron Trioxide Powder (wt %) | Graphite Powder (wt %) | Zinc Stearate (wt %) | Atmos-phere | Content of Bonded Carbon (wt %) |
|---|---|---|---|---|---|---|
| 9 | 98.2 | 0 | 1.0 | 0.8 | a | 0.68 |
| 10 | 98.19 | 0.01 | 1.0 | 0.8 | a | 0.28 |
| 11 | 98.0 | 0.2 | 1.0 | 0.8 | a | 0.23 |
| 12 | 97.8 | 0.4 | 1.0 | 0.8 | a | 0.21 |
| 13 | 97.6 | 0.6 | 1.0 | 0.8 | a | 0.20 |
| 14 | 97.4 | 0.8 | 1.0 | 0.8 | a | 0.20 |
| 15 | 97.2 | 1.0 | 1.0 | 0.8 | a | 0.20 |
| 16 | 97.0 | 1.2 | 1.0 | 0.8 | a | 0.20 |
| 17 | 98.2 | 0 | 1.0 | 0.8 | b | 0.74 |
| 18 | 98.19 | 0.01 | 1.0 | 0.8 | b | 0.40 |
| 19 | 98.0 | 0.2 | 1.0 | 0.8 | b | 0.32 |
| 20 | 97.8 | 0.4 | 1.0 | 0.8 | b | 0.30 |
| 21 | 97.6 | 0.6 | 1.0 | 0.8 | b | 0.28 |
| 22 | 97.4 | 0.8 | 1.0 | 0.8 | b | 0.26 |
| 23 | 97.2 | 1.0 | 1.0 | 0.8 | b | 0.25 |
| 24 | 97.0 | 1.2 | 1.0 | 0.8 | b | 0.25 |

TABLE 3-continued

| Sample No. | Iron Powder (wt %) | Diboron Trioxide Powder (wt %) | Graphite Powder (wt %) | Zinc Stearate (wt %) | Atmos-phere | Content of Bonded Carbon (wt %) |
|---|---|---|---|---|---|---|
| 25 | 98.2 | 0 | 1.0 | 0.8 | c | 0.80 |
| 26 | 98.19 | 0.01 | 1.0 | 0.8 | c | 0.40 |
| 27 | 98.0 | 0.2 | 1.0 | 0.8 | c | 0.37 |
| 28 | 97.8 | 0.4 | 1.0 | 0.8 | c | 0.34 |
| 29 | 97.6 | 0.6 | 1.0 | 0.8 | c | 0.31 |
| 30 | 97.4 | 0.8 | 1.0 | 0.8 | c | 0.28 |
| 31 | 97.2 | 1.0 | 1.0 | 0.8 | c | 0.28 |
| 32 | 97.0 | 1.2 | 1.0 | 0.8 | c | 0.28 |

FIG. 1 is a graph showing the relationship between the content of diboron trioxide and the content of bonded carbon in the sintered iron alloy material, using the above results. In FIG. 1, the results of measurements of Sample Nos. 9 to 16 are illustrated by the line with reference numeral 1, those of Sample Nos. 17 to 24 are illustrated by the line with number 2, and those of Sample Nos. 25 to 32are illustrated by the line with number 3.

As shown in FIG. 1, the content of the bonded carbon is remarkably reduced to 0.2 to 0.4% by weight by addition of diboron trioxide of 0.01 to 1.0% by weight, and this tendency is similar in every sintering atmosphere, irrespective of the kind of the sintering atmosphere. In view of the above results, it is considered that, because of a content of the bonded carbon which is reduced to 0.4% by weight or less, that is, because of most of the carbon being free graphite, the sintered iron alloy material with the boron component according to the present invention exhibits prominent machinability.

As clearly understood from the above description, the sintered iron alloy obtained by compacting and sintering of a powdered raw material containing iron, carbon and the boron component according to the present invention has a metallographic structure in which most of the carbon is in a free state and dispersed in the iron base composed of the ferrite phase and the pearlite phase. This is considered as a result of inhibition of diffusion of the graphite into the iron base.

Example 4

[Effect of Boron Component as Surface Modifier]

(Preparation of Raw Materials)

The following powdered materials were prepared.

A simple iron powder having a mean particle size of 50 μm

A copper powder having a mean particle size of 30 μm

A graphite powder having a mean particle size of 5 μm.

A zinc stearate powder for the powder lubricant having a mean particle size of 5 μm (Manufacture of Sample Nos. 33a, 33b and 33c)

The raw material powders were blended at a mixing ratio of 1.5% by weight of copper, 1.0% by weight of graphite, 0.8% by weight of zinc stearate and balance iron, to obtain a mixture. Moreover, the mixture was agitated for 30 minutes by using a V-shaped rotary blender. The mixture was compacted into many planar green compacts each of which had a dimension of 12.5 mm×32 mm×10 mm and a green density of 6.6 g/cm$^3$.

A third part of the green compacts was further presintered in a non-oxidizing atmosphere at a temperature of about 690° C. for 60 minutes and then cooled to a room temperature to produce test plates made of a presintered iron alloy material. Another third part of the green compacts was sintered in the non-oxidizing atmosphere at a temperature of about 1,130° C. for 60 minutes and then cooled to a room temperature to obtain test plates made of a sintered iron alloy material. In the presintering operation and the sintering operation, a dissociated ammonia atmosphere was used as the non-oxidizing atmosphere.

In the item of Surface Modification Treatment and Measurement of Hardness and Thickness of Modified Layer, which will be described below, the green compact obtained above was used as a test plate of Sample No. 33a, the test plate of the presintered iron alloy material was used as that of Sample No. 33b, and that of the sintered iron alloy material was as of Sample No. 33c.

(Preparation of Surface Modifier)

Each of surface modifiers A to G was prepared, referring to Table 4, by dissolving the boron component into the solvent at a concentration described in Table 4.

TABLE 4

| Surface Modifier | Boron Component | Solvent | Concentration (g/100 ml) |
|---|---|---|---|
| A | diboron trioxide ($B_2O_3$) | ethanol | 10 |
| B | orthoboric acid ($H_3BO_3$) | water/ethanol (1/1) | 20 |
| C | borax ($Na_2B_4O_7$) | water/ethanol (1/1) | 15 |
| D | boron triiodide ($BI_3$) | ethanol | 20 |
| E | boron sulfide ($B_2S_3$) | ethanol | 15 |
| F | boron halide ($Bi_{10}H_{14}$ ) | ethanol | 2 |
| G | ammonium tetrafluoroborate ($NH_4BF_4$) | ethanol | 20 |

(Surface Modification Treatment)

In an atmospheric air, the surface modifier A was applied with an absorbent cotton to each of the test plates of Sample Nos. 33a, 33b and 33c, respectively, and each of the test plates impregnated with the surface modifier A was dried. This application operation was repeated twice more for each plate.

Each of the test plates of Sample No. 33a, 33b and 33c with the surface modifier A was heated in a non-oxidizing gas (dissociated ammonia) atmosphere at a temperature of 1,130° C. to obtain the surface-treated plate from each of the test plates of Sample Nos. 33a, 33b and 33c.

For another group of test plates of Sample Nos. 33a, 33b and 33c, the above surface modification treatment was repeated, excepting that the surface modifier was changed to the surface modifier B, respectively. Moreover, changing the surface modifier, the same treatment was repeated for the surface modifiers C, D, E, F and G.

(Measurement of Hardness and Thickness of Modified Layer)

For each of the surface-treated plates obtained by surface-treating each of the test plates of Sample Nos. 33a, 33b and 33c with each of the surface modifiers A to G, Rockwell B hardness (HRB) and the thickness of the modified layer were measured. The results of the measurements are shown in Table 5.

Figure 2:
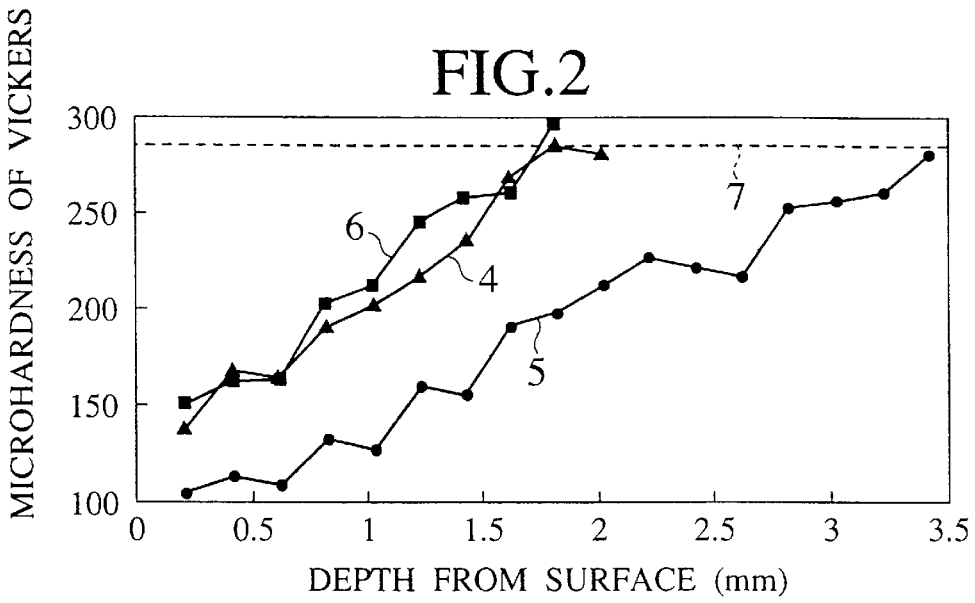
FIG. 2 is a graph showing the relationship between the microhardness of Vickers (MHV) of the iron alloy and the depth from the surface, for comparison of the case of using the surface modifier of the present invention with the case of no surface modification.

As to the thickness of the modified layer, microhardness of Vickers (MHV) of the test plate was measured at every depth from the surface, while the depth was varied from 0.2 mm to 3.4 mm. From the obtained results, a graph showing the relationship between the microhardness and the depth was obtained, and the value of the depth at which the microhardness was 200 was determined from the graph and that value of the depth was regarded as a thickness of the modified layer which was produced by the surface modification treatment. FIG. 2 is a graph showing the relationship between the microhardness and the depth in a case of using the surface modifier A and that of no surface modification in a test plate of Sample No. 33c. In FIG. 2, the solid line with reference numeral 4 shows the case of Sample No. 33a with the surface modifier A, the solid line 5 for the case of Sample No. 33b with the surface modifier A, the solid line 6 for the case of Sample No. 33c with the surface modifier A, and the dotted line 7 is for the case of Sample No. 33c with no surface modification.

TABLE 5

| Surface Modifier | Sample No. | Density ($g/cm^3$) | Hardness HRB | Thickness of Modified Layer (mm) |
|---|---|---|---|---|
| — | 33c | 6.58 | 69 | 0 |
| A | 33a | 6.59 | 56 | 0.8 |
| A | 33b | 6.57 | 35 | 1.8 |
| A | 33c | 6.57 | 52 | 0.8 |
| B | 33a | 6.62 | 58 | 0.7 |
| B | 33b | 6.59 | 37 | 1.6 |
| B | 33c | 6.57 | 54 | 0.6 |
| C | 33a | 6.58 | 59 | 0.5 |
| C | 33b | 6.57 | 45 | 1.2 |
| C | 33c | 6.58 | 57 | 0.5 |
| D | 33a | 6.60 | 62 | 0.3 |
| D | 33b | 6.60 | 55 | 0.8 |
| D | 33c | 6.57 | 60 | 0.4 |
| E | 33a | 6.59 | 58 | 0.4 |
| E | 33b | 6.57 | 46 | 1.1 |
| E | 33c | 6.58 | 55 | 0.4 |
| F | 33a | 6.58 | 57 | 0.7 |
| F | 33b | 6.58 | 39 | 1.6 |
| F | 33c | 6.57 | 54 | 0.6 |
| G | 33a | 6.60 | 59 | 0.3 |
| G | 33b | 6.59 | 48 | 0.7 |
| G | 33c | 6.57 | 57 | 0.2 |

As shown in Table 5, it is possible, with any of the surface modifiers A to G, to remarkably reduce the hardness of the surface of the test plate so that it is less than that of the inner portion thereof. This is considered to be a result of the surface modification that produces a metallographic structure in which a large amount of the ferrite phase is contained. Of the above surface modifiers A to G, the surface modifier A, i.e., the solution of diboron trioxide, is the most effective for inhibition of diffusion of carbon.

Moreover, hardness of the modified layer produced on the presintered compact is distinctly reduced and thickness of the modified layer increases, in comparison with the cases of the green compact and the sintered iron alloy. As easily understood from the above results, the thickness of the layer which is almost composed of the ferrite phase and which is produced by surface treatment with the surface modifier of the present invention possibly extends to about 1.8 mm.

(Measurement of Machinability of Modified Layer)

To prepare test plates for a drilling test which measured machinability of the modified layer, the test plates of Sample No. 33b was placed in a vacuum and impregnated fully with the surface modifier A so that the test plates was perfectly modified not only on the surface but also into the inside. Moreover, the test plates impregnated fully with the surface modifier A were sintered in the same conditions as that of surface-treated test plates.

Figure 3:
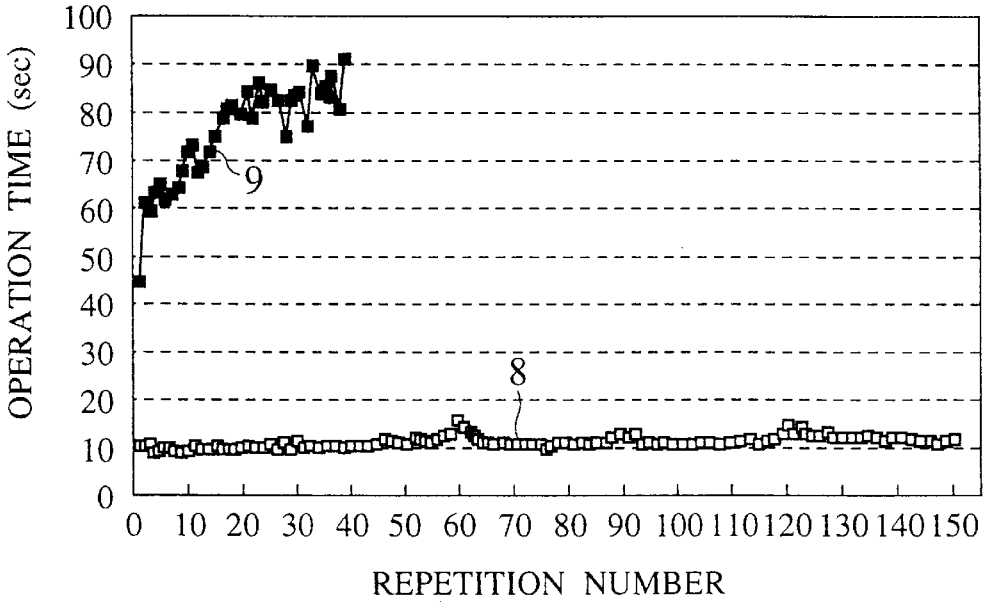
FIG. 3 is a graph showing the relationship between the repetition number of the drilling operation and the operation time for drilling up the iron alloy, for comparison of the case of using the surface modifier of the present invention with the case of no surface modification.

The test plate obtained by the above method were subjected to the drilling test described in Measurement of Mechanical Properties of Example 1, and the operation time necessary for drilling up the test plate was measured. This measurement was repeated for one hundred and fifty times on the surface-treated test plates in the same conditions. The same measurement with a flesh drill was also subjected for forty times on the test plates of Sample No. 33c with no surface modification. The results of the measurement are shown in FIG. 3. FIG. 3 is a graph showing the relationship between the repetition number of the drilling operation and the operation time for drilling up, and the results of Sample No. 33b with surface modifier A are shown by the reference numeral 8, and those of Sample No. 33c with no surface modifier are shown by the reference numeral 9.

As known from FIG. 3, the test plates modified with the surface modifier A can be easily processed many times. In comparison with this, the operation time of the test plate with no surface treatment increases in accordance with repetition of the drilling operation, and this seems due to damage of the drill. As a result of the above, it is clear that surface modification with the surface modifier of the present invention improves machinability of the iron alloy material.

Example 5

[Control of Surface Modification]

(Preparation of Surface Modifier)

Referring to Table 6, each of surface modifiers H, I and J was prepared by dissolving diboron trioxide into 100 ml ethanol at a concentration described in Table 6.

(Surface Modification Treatment)

By using each of the following application methods (1), (2) and (3), the surface modifier H was impregnated into a test plate of Sample No. 33a which was prepared in Example 4.

Application method (1): In an atmospheric air, the surface modifier was applied with an absorbent cotton to the test plate, and the test plate impregnated with the surface modifier was dried. The above application operation was repeated twice more.

Application method (2): In an atmospheric air, the test plate was dipped in the surface modifier for 15 minutes for impregnation. It was then removed from the surface modifier and dried.

Application method (3): The test plate was placed in a vacuum and then impregnated with the surface modifier. Moreover, it was placed in an atmospheric air and dried. [so-called vacuum impregnation]

After the above-described application, each of the test plates was heated in a non-oxidizing gas (dissociated ammonia) atmosphere at a temperature of 1,130° C. to obtain the surface-treated plate.

The above surface modification treatment was repeated, excepting that the surface modifier was changed to either of the surface modifiers I and J.

(Measurement of Hardness and Thickness of Modified Layer)

For each of the surface-treated plates of Sample No. 33a obtained by each of the surface-treating method (1) to (3) with each of the surface modifiers H, I and J, the Rockwell B hardness (HRB) and the thickness of the modified layer were measured by using the method described in Example 4. The results of the measurements are shown in Table 6.

TABLE 6

| Surface Modifier | Concentration (g/100 ml) | Application Method | Hardness HRB | Thickness of Modified Layer (mm) |
|---|---|---|---|---|
| H | 5 | (1) | 65 | 0.2 |
| H | 5 | (2) | 63 | 0.5 |
| H | 5 | (3) | 60 | 1.6 |
| I | 10 | (1) | 56 | 0.8 |
| I | 10 | (2) | 50 | 1.3 |
| I | 10 | (3) | 42 | 2.7 |
| J | 15 | (1) | 52 | 1.3 |
| J | 15 | (2) | 45 | 2.2 |
| J | 15 | (3) | 36 | 3.8 |
| — | — | — | 69 | 0 |

As shown in Table 6, in each of the application methods (1) to (3), the hardness of the test plate is reduced, according as the concentration of the applied surface modifier increases. This means that, the higher is the concentration of the boron component in the used surface modifier, the larger is the amount of the ferrite phase of the modified layer. Moreover, in comparison with the case of the application method (1), the modified layer produced by either of the application methods (2) or (3) is thicker. Especially, in the case of impregnating the surface modifier having a concentration of 15 g/100 ml in vacuum, the surface modification develops to a depth of 3.8 mm from the surface to produce a modified layer which has a metallographic structure containing a large amount of ferrite phase and in which the microhardness of Vickers, MHV is 200 or less.

Example 6

[Control of Surface Modification]

(Raw Materials)

For the base material containing iron, the following powdered materials were prepared.

A simple iron powder having a mean particle size of 50 μm

A partially diffused alloy powder being composed of 1.5% by weight of copper, 4.0% by weight of nickel, 0.5% by weight of molybdenum and the balance iron and having a mean particle size of 45 μm An iron alloy powder (1) being composed of 2.0% by weight of nickel, 0.5% by weight of molybdenum and the balance iron and having a mean particle size of 50 μm An iron alloy powder (2) being composed of 1.0% by weight of chromium, 0.7% by weight of manganese, 0.3% by weight of molybdenum and the balance iron and having a mean particle size of 50 μm Moreover, for the additives, the following powdered materials were prepared.

A copper powder having a mean particle size of 30 μm

A nickel powder having a mean particle size of 25 μm

A molybdenum powder having a mean particle size of 5 μm

A graphite powder having a mean particle size of 5 μm.

A zinc stearate powder for the powder lubricant having a mean particle size of 5 μm (Preparation of Mixtures (1) to (6))

Referring to the composition ratio described in Table 7, the above raw material powders were blended and agitated for 30 minutes by using a V-shaped rotary blender to obtain each of mixtures (1), (2), (3), (4), (5) and (6).

TABLE 7

| Mixture | Base Material (balance) | Additives (wt %) Cu | Ni | Mo | Graphite | zinc stearate |
|---|---|---|---|---|---|---|
| (1) | simple iron powder | 1.5 | — | — | 1.0 | 0.8 |
| (2) | simple iron powder | — | 3.0 | — | 1.0 | 0.8 |
| (3) | simple iron powder | 2.0 | 3.0 | — | 1.0 | 0.8 |
| (4) | partially diffused alloy powder | 1.5 | 4.0 | 0.5 | 1.0 | 0.8 |
| (5) | iron alloy powder (1) | — | — | — | 1.0 | 0.8 |
| (6) | iron alloy powder (2) | — | — | — | 1.0 | 0.8 |

(Manufacture of Green Compact A1 to A6, B1 to B6, C1 to C6, and D1 to D6)

In accordance with the method used for manufacture of Sample No. 33a in Example 4, each of green compacts A1, A2, A3, A4, A5 and A6 was similarly manufactured from each of the above mixtures (1) to (6), respectively.

For the mixtures (1) to (6), the above manufacturing operation was repeated, excepting that the green density was changed to 6.8 g/cm$^3$, to obtain green compacts B1, B2, B3, B4, B5 and B6.

Similarly, green compacts C1, C2, C3, C4, C5 and C6 were manufactured at a green density of 7.0 g/cm$^3$ from the mixtures (1) to (6).

Moreover, green compacts D1, D2, D3, D4, D5 and D6 were similarly manufactured at a green density of 7.2 g/cm$^3$ from the mixtures (1) to (6).

(Surface Modification Treatment)

For each of the green compacts A1 to A6, B1 to B6, C1 to C6 and D1 to D6, the operation of surface modification treatment of Example 4 was repeated, with use of the surface modifier A.

(Measurement of Thickness of Modified Layer)

For each of the surface-treated plates obtained by surface-treating each of the green compacts A1 to A6, B1 to B6, C1 to C6 and D1 to D6, the thickness of the modified layer was measured by using the method described in Example 4. The results of the measurements are shown in Table 8.

TABLE 8

| Mixture | Green Density (g/cm$^3$) [Green Compact | Thickness of Modified Layer (mm) 6.6 A1-A6 | 6.8 B1-B6 | 7.0 C1-C6 | 7.2 D1-D6] |
|---|---|---|---|---|---|
| (1) | | 0.8 | 0.7 | 0.5 | 0.3 |
| (2) | | 0.7 | 0.5 | 0.4 | 0.3 |
| (3) | | 0.6 | 0.4 | 0.4 | 0.2 |
| (4) | | 0.4 | 0.4 | 0.2 | 0.1 |
| (5) | | 1.0 | 0.9 | 0.7 | 0.5 |
| (6) | | 1.1 | 1.0 | 0.7 | 0.4 |

Each of the surface-treated plates obtained by treating each of the green compacts A1 to A6, B1 to B6, C1 to C6 and D1 to D6 had a modified layer which contained a large amount of ferrite phase.

The results in Table 8 show a relationship between the green density of the compact to be surface-treated and the thickness of the modified layer produced by the surface modification treatment, and there is a distinct tendency that the thickness of the modified layer is reduced according as the green density of the compact to be treated increases. It is considered that this tendency is due to the difference in permeability of the surface modifier into the body, and it does not vary with a change in the composition of the compact to be treated.

Example 7

[Surface Modification for the Purpose of Sizing]

Figure 4:
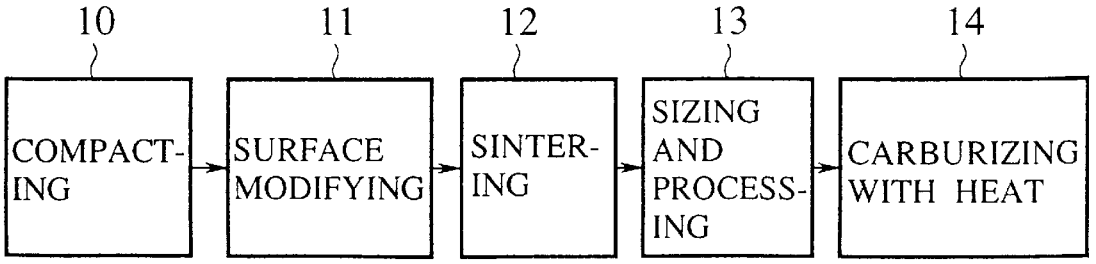
FIG. 4 is a block diagram showing a process of manufacturing a iron alloy member in which the surface modification treatment of the present invention is employed.

FIG. 4 is an example of applying the surface modification treatment of the present invention to improve the processing ability and recompressibility in sizing operation, and the process of FIG. 4 has steps of: compacting (10); surface modifying (11); sintering (12); sizing and processing (13); and carburizing with heat (14).

In accordance with the process of FIG. 4, the following operation was carried out.

(Manufacture of Sample Nos. 34 and 35)

The mixture (4) of Example 6 was compacted into tubular green compacts which had an inner diameter of 20 mm, an outer diameter of 30 mm, a length of 10 mm and a green density of 6.6 g/cm$^3$. Twenty pieces of the green compacts were formed.

In an atmospheric air, the surface modifier A prepared in Example 4 was applied with an absorbent cotton to the outer surface of ten compacts of the above-obtained green compacts. This application operation was repeated twice more for each compact. Then, the applied compacts were sintered in a non-oxidizing gas atmosphere (dissociated ammonia) at a temperature of 1,250° C. to obtain the sintered bodies of Sample No. 34.

Another ten green compacts were sintered in a non-oxidizing gas atmosphere (dissociated ammonia) at a temperature of 1,250° C., without application of the surface modifier, to obtain the sintered bodies of Sample No. 35.

(Sizing and Carburizing)

Each of the sintered bodies of Sample Nos. 34 and 35 was repressed in a mold at a repressing pressure of 500 MPa, and the outer diameter of the sintered bodies of Sample Nos. 34 and 35 was measured for estimation of dimensional difference. The results are shown in Table 9.

For carburization, the sintered bodies of Sample Nos. 34 and 35 obtained after the above repressing operation were heated at a temperature of 850° C. for 60 minutes in an atmosphere which has a carbon potential value of 0.8%. Moreover, they were hardened in an oil of 60° C. and then tempered in an atmospheric air of 180° C. For each of the sintered bodies, the above measurement of the outer diameter was repeated to estimate the dimensional difference. Moreover, each of the sintered bodies was measured for radial crushing strength by means of an Amsler type universal tester. The results of the above measurements are shown in Table 10.

In Table 9 and Table 10, Difference of Outer Diameter means the difference between the maximum value and the minimum value of the outer diameter.

TABLE 9

| Sample No. | Outer Diameter (mm) Minimum | Maximum | Difference ($\mu$m) |
|---|---|---|---|
| 34 | 29.916 | 29.939 | 23 |
| 35 | 29.936 | 29.993 | 57 |

TABLE 10

| Sample No. | Outer Diameter Minimum (mm) | Outer Diameter Maximum (mm) | Outer Diameter Difference (μm) | Radial crushing Strength (MPa) |
|---|---|---|---|---|
| 34 | 29.919 | 29.953 | 34 | 1354 |
| 35 | 29.942 | 30.014 | 72 | 1232 |

Since the surface portion of the sintered body is made soft by the impregnated surface modifier, the dimension of the sintered body can be easily corrected by sizing operation. The effect of making fine the surface portion of the sintered body can be also obtained by sizing of the soft surface portion. Moreover, mechanical strength is imparted to the surface portion of the sintered body by the final carburizing treatment.

As clearly shown in the above description, the surface modification according to the present invention comprises the step of impregnating the surface modifier containing the boron component into either of a compact, a presintered compact or a sintered body which is composed of an iron alloy with carbon, and the step of sintering or heating the compact or the sintered body impregnated with the surface modifier. Since this surface modification reduces hardness of only the impregnated portion in the iron alloy material, it makes possible to manufacture a sintered iron alloy which is prominent in processing ability, for example, machinability, sizing easiness, etc., at a low cost.

Moreover, the surface modification of the present invention is applicable to not only a sintered iron alloy material, but also a steel and other common iron materials which contain carbon, and it is possible to manufacture various machine parts and members at low costs by using the easily machinable material which is obtained by applying the surface modifier to either of these materials and sintering it. As a result of above, the field in which the sintered iron alloy and other iron materials can be utilized becomes more wide.

As there are many apparently widely different embodiments of the present invention that may be made without departing from the spirit and scope thereof, it is to be understood that the invention is not limited to the specific embodiments thereof, except as defined in the appended claims.

What is claimed is:

1. A process for manufacturing a sintered iron alloy, comprising the steps of:

preparing a powdered mixture comprising: boron compound which is selected from the group consisting of boron oxide, boron sulfide, boron, halide, boron hydride, boric acid, borate and tetraflouroborate; 0.1 to 2.0% by weight of graphite; and iron;

compressing said powdered mixture to form a green compact; and sintering said green compact in a non-oxidizing atmosphere at a temperature of 1,000° to 1,250° C.

2. The manufacturing process of claim 1, wherein the green compact at the compressing step is formed to have a green density of about 6.4 to 7.2 g/cm$^3$, and the non-oxidizing atmosphere of the sintering step is selected from the group consisting of hydrogen gas, nitrogen gas, dissociated ammonia gas, argon gas, exothermic gas, endothermic gas and vacuum.

3. A process for manufacturing a sintered iron alloy comprising the steps of:

preparing a powdered mixture comprising: 0.01 to 1.0% by weight of diboron trioxide, 0.1 to 2.0% by weight of graphite, and iron;

compressing said powdered mixture to form a green compact; and sintering said green compact in a non-oxidizing atmosphere at a temperature of 1,000° to 1,250° C.

4. The manufacturing process of claim 3, wherein the boron compound is introduced into the powdered mixture by adding boron nitride powder which contains diboron trioxide at a content of 10 to 40% by weight as an impurity.

5. A process of manufacturing a sintered iron alloy, comprising the steps of:

preparing a powdered mixture comprising iron and containing 0.1 to 2.0% by weight of graphite;

compressing the powdered mixture to form a green compact;

preparing a solution containing a boron component which is selected from the group consisting of boron, boron oxide, boron sulfide, boron halide, boron hydride, boric acid, borate and tetrafluoroborate;

impregnating the solution into the green compact; and sintering the green compact in a non-oxidizing atmosphere at a temperature of 1,000° to 1,250° C. to obtain a sintered iron alloy.

6. The manufacturing process of claim 5, further comprising the step of:

placing the green compact, before the impregnating step, in an atmosphere of a reduced pressure to remove air from the green compact.

7. The manufacturing process of claim 5, further comprising the steps of:

processing the sintered iron alloy; and carburizing the sintered iron alloy after the processing step.

8. A process of manufacturing a sintered iron alloy, comprising the steps of:

preparing a powdered mixture comprising iron and containing 0.1 to 2.0% by weight of graphite;

compressing the powdered mixture to form a green compact;

presintering the green compact at a temperature of 300° to 950° C. to obtain a presintered compact;

preparing a solution containing a boron component which is selected from the group consisting of boron, boron oxide, boron sulfide, boron halide, boron hydride, boric acid, borate and tetrafluoroborate;

impregnating the solution into the presintered compact to obtain impregnated compact; and sintering the impregnated compact in a non-oxidizing atmosphere at a temperature of 1,000° to 1,250° C.

9. The manufacturing process of claim 8, further comprising the step of placing the presintered compact, before the impregnating step, in an atmosphere of a reduced pressure to remove air from the presintered compact.

10. The manufacturing process of claim 8, further comprising the steps of:

processing the sintered iron alloy; and carburizing the sintered iron alloy after the processing step.

11. A method of modifying an iron alloy containing carbon, comprising the steps of:

preparing a solution containing a boron component which is selected from the group consisting of boron, boron oxide, boron sulfide, boron halide, boron hydride, boric acid, borate and tetrafluoroborate;

impregnating the solution into the iron alloy; and heating the iron alloy after the impregnating step in a non-oxidizing atmosphere at a temperature of 1,000° to 1,250° C.

12. The modification method of claim 11, wherein the solution is prepared by dissolving the boron component at a concentration of 0.01 to 0.3 g/ml into a solvent including water or alcohol which is selected from the group consisting of methanol, ethanol, 1-propanol and 2-propanol.

13. The modification method of claim 11, further comprising the step of:

placing the iron alloy, before the impregnating step, in an atmosphere of a reduced pressure to remove air from the iron alloy.

14. The manufacturing process of claim 1, wherein the green compact at the compressing step is formed to have a green density of about 6.4 to 7.2 g/cm$^3$.

15. The manufacturing process of claim 1, wherein the non-oxidizing atmosphere of the sintering step is selected from the group consisting of hydrogen gas, nitrogen gas, dissociated ammonia gas, argon gas, exothermic gas, endothermic gas and vacuum.

16. A process for manufacturing a sintered iron alloy, comprising the steps of:

preparing a powdered mixture comprising: boron compound which is selected from the group consisting of boron, boron oxide, boron sulfide, boron, halide, boron hydride, boric acid, borate and tetraflouroborate; 0.1 to 2.0% by weight of graphite; and iron;

compressing said powdered mixture to form a green compact; and sintering said green compact in a non-oxidizing atmosphere at a temperature of 1,000° to 1,250° C.

* * * * *